US010557629B2

(12) United States Patent
Bunce et al.

(10) Patent No.: US 10,557,629 B2
(45) Date of Patent: Feb. 11, 2020

(54) STEAM GENERATOR

(71) Applicants: ROLLS-ROYCE PLC, London (GB); ROLLS-ROYCE POWER ENGINEERING PLC, Derby (GB)

(72) Inventors: Ian Michael Bunce, Derby (GB); Nigel Alastair Town, Derby (GB); Mark Alwyn Thomas Causton, Derby (GB); Matthew Charles Blake, Derby (GB); David William Mills, Derby (GB)

(73) Assignees: ROLLS-ROYCE plc, London (GB); ROLLS-ROYCE POWER ENGINEERING plc, Derby (GB)

( * ) Notice: Subject to any disclaimer, the term of this patent is extended or adjusted under 35 U.S.C. 154(b) by 824 days.

(21) Appl. No.: 14/601,492

(22) Filed: Jan. 21, 2015

(65) Prior Publication Data

US 2015/0226420 A1 Aug. 13, 2015

(30) Foreign Application Priority Data

Feb. 7, 2014 (GB) ..... 1402112.5

(51) Int. Cl.

| | |
|---|---|
| ***G21C 19/28*** | (2006.01) |
| ***F22B 21/30*** | (2006.01) |
| ***F22B 1/16*** | (2006.01) |
| ***F22B 21/12*** | (2006.01) |
| *G21D 1/00* | (2006.01) |

(52) U.S. Cl.

CPC ..... *F22B 21/30* (2013.01); *F22B 1/162* (2013.01); *F22B 21/126* (2013.01); *G21D 1/006* (2013.01)

(58) Field of Classification Search

CPC ..... G21D 1/006; F22B 21/30; F22B 21/26; F22B 1/162

USPC ..... 376/378

See application file for complete search history.

(56) References Cited

U.S. PATENT DOCUMENTS

| | | | | |
|---|---|---|---|---|
| 4,531,577 A * | 7/1985 | Humpolik | F28F 9/167 165/150 |
| 2004/0261974 A1* | 12/2004 | Pigatto | F28D 7/16 165/70 |
| 2013/0279643 A1* | 10/2013 | Groome | G21D 1/006 376/378 |

FOREIGN PATENT DOCUMENTS

| | | | |
|---|---|---|---|
| GB | 585630 | * | 2/1947 |
| GB | 585630 | A | 2/1947 |
| GB | 1329423 | A | 9/1973 |
| JP | 2006-207937 | A | 8/2006 |
| JP | 2006207937 | * | 8/2006 |
| JP | 2007-240078 | A | 9/2007 |

OTHER PUBLICATIONS

Sep. 19, 2014 Search Report issued in British Patent Application No. GB1402112.5.

* cited by examiner

*Primary Examiner* — Marshall P O'Connor
(74) *Attorney, Agent, or Firm* — Oliff PLC

(57) ABSTRACT

A steam generator comprising a vessel having an inlet and an outlet, and in use a primary fluid flow enters the vessel through the inlet and exits the vessel through the outlet. A plurality of modules are connected in series and at least partially housed within the vessel, and each module comprises at least one tube. The modules are arranged such that at least one tube of one module is coaxial with at least one tube of an adjacent module so as to define a conduit through which a secondary fluid can flow from one module to an adjacent module.

16 Claims, 4 Drawing Sheets

STEAM GENERATOR

FIELD OF INVENTION

The present invention relates to a steam generator and/or a steam generator system.

BACKGROUND

There are numerous different types of steam generators used for multiple functions. One such function is use in a pressurised water reactor (often referred to as a PWR). When used in a PWR, primary coolant is used to transport heat between a reactor core and a steam generator. In the steam generator, the primary coolant is cooled by a secondary coolant, or in other words a secondary coolant is heated and converted to steam by the primary coolant. Once heated, the secondary coolant is used to turn a turbine which is connected to a generator to generate electricity.

Generally, the steam generator will include a bundle of tubes at least partially contained within a vessel. The primary coolant may be supplied to the tubes and the secondary fluid may be supplied to the vessel, or vice-versa. The wall of the tubes separates the primary coolant from the secondary coolant, which is of particular importance because the primary coolant may be radioactive. As such, when designing a steam generator it is important to ensure that the integrity of the conduit is not compromised.

Large steam generators, particularly those of PWRs, require a large surface area to meet the heat transfer requirements; as such a large number of tubes and/or large lengths of tubes are required. This means that the design requirements on the tubes for a steam generator, and the transport and installation of a steam generator can be complex and costly.

Furthermore, a compromise often needs to be made between performance of a steam generator and design parameters such as tube geometry, size and materials.

SUMMARY OF INVENTION

The following disclosure aims to mitigate one or more of the problems associated with steam generators of the prior art.

A first aspect of the invention provides a steam generator comprising:

- a vessel having an inlet and an outlet, in use, a primary fluid flow enters the vessel through the inlet and exits the vessel through the outlet; and
- a plurality of modules connected in series and at least partially housed within the vessel, wherein each module comprises at least one tube and the modules are arranged such that at least one tube of one module is coaxial with at least one tube of an adjacent module so as to define a conduit through which a secondary fluid can flow from one module to an adjacent module.

The person skilled in the art realises that the integrity of the conduit is extremely important, not least so as to avoid leakage (and therefore contamination) between the primary and the secondary flow. As such, the person skilled in the art would be prejudiced against a modular arrangement of the conduit. The inventor of the present invention has taken the inventive step of providing a modular arrangement of the conduit and has surprisingly found that the pressure of the primary fluid contributes to holding the connected modules together, which means that the risk of leakage from or to the secondary fluid flow in the conduit is at an acceptable level.

The modular arrangement of the conduit means that large steam generators can be manufactured as smaller individual modules, which eases transportation and installation of steam generators because the component parts are smaller. Moreover, the modular arrangement may allow for more complex designs of steam generator. Further, maintenance of the described steam generator may be eased because a single module can be inspected and/or replaced as required.

The skilled person understands that a primary fluid flow that enters the steam generator at a higher temperature and a higher pressure than the secondary fluid flow. For example, the primary fluid flow may flow from a reactor and the secondary fluid flow may flow to a turbine.

Each module may comprise a plurality of tubes. The modules may be arranged so that each of the plurality of tubes is coaxial with one of the tubes of an adjacent module so as to form a conduit bundle comprising a plurality of conduits.

Each module may comprise a flange plate positioned at an axial end of the at least one tube. Adjacent modules may be connected together via the flange plates.

Each flange plate may comprise a plurality of holes. Each hole may receive one of the plurality of tubes.

The steam generator may comprise an intermediate plate positioned between adjacent flange plates of adjacent modules. The intermediate plate may comprise one or more holes for receiving the tubes of the adjacent modules.

The intermediate plate and two flange plates may be bolted together. Alternatively, the intermediate plate and the flange plates may be welded together.

The steam generator may comprise a seal, e.g. an O-ring seal, between adjacent flange plates and the intermediate plate.

The flange plates may be formed as a separate component to the tubes.

One or more of the plurality of flange plates may be integrally formed with the vessel.

The conduit may be U-shaped.

Alternatively, the conduit may be helical. In an exemplary embodiment, one tube may define one turn of the helical conduit and an adjacent tube may define and adjacent turn of the helical conduit.

The vessel may be made using standard configuration. That is, the vessel is not modular (e.g. the vessel wall is defined by a single component) or is modular to a lesser extent than the tube configuration (e.g. at least the majority of the vessel wall that surrounds the conduit is defined by a single component).

A second aspect of the invention provides a steam generator comprising one or more tube bundles, the steam generator being configured to receive a secondary flow through the tube bundles and a primary flow outside the tube bundles;

- wherein each tube bundle comprises a first sub-bundle connected in series to a second sub-bundle,
- wherein each of the first and second sub-bundles comprise a plate including a plurality of holes, each hole receiving a tube of the respective first or second sub-bundle, and
- wherein the plate of the first sub-bundle connects to the plate of the second sub-bundle and the first and second sub-bundles are arranged such that the tubes of the first sub-bundle are substantially coaxial to the tubes of the second sub-bundle, such that in use, fluid flows from the first sub-bundle to the second sub-bundle.

As will be appreciated by the person skilled in the art, any one, or any combination, of the optional features of the first aspect may be applied to the second aspect.

A third aspect of the invention provides a steam generator system comprising the steam generator according to the first or second aspect; a primary fluid flow channel connecting to the inlet of the vessel and for connection to a heat source (e.g. a nuclear reactor); and a secondary fluid flow channel connecting to the outlet of the vessel and for connection to a turbine.

A fourth aspect of the invention provides a method of assembly of a steam generator, the method comprising:

- providing a first module having at least one tube and a second module having at least one tube;
- positioning the first module adjacent the second module such that the at least one tube of the first module is substantially coaxial to the at least one tube of the second module;
- connecting the first module to the second module; and
- positioning the first module and the second module within a vessel, the vessel having an inlet and an outlet for receiving a primary fluid flow.

The steam generator may be the steam generator of the first aspect.

A fifth aspect of the invention provides a method of assembly of a steam generator, the method comprising:

- providing a first sub-bundle and a second sub-bundle, each sub-bundle comprising a plurality of tubes for receiving a secondary fluid flow and a flange plate positioned at an axial end of the plurality of tubes;
- positioning the flange of the first sub-bundle adjacent the flange of the second sub-bundle and arranging the first and second sub-bundles such that each of the tubes of the first sub-bundle are coaxial with one of the tubes of the second sub-bundle;
- connecting the first sub-bundle to the second sub-bundle via the flange of each of the first and second sub-bundles so as to form a conduit bundle; and
- positioning the conduit bundle at least partly within a vessel, the vessel having an inlet and an outlet for receiving a primary fluid flow.

The steam generator may be the steam generator of the second aspect.

DESCRIPTION OF DRAWINGS

The invention will now be described, by way of example only, with reference to the accompanying drawings in which.

DETAILED DESCRIPTION

Figure 1:
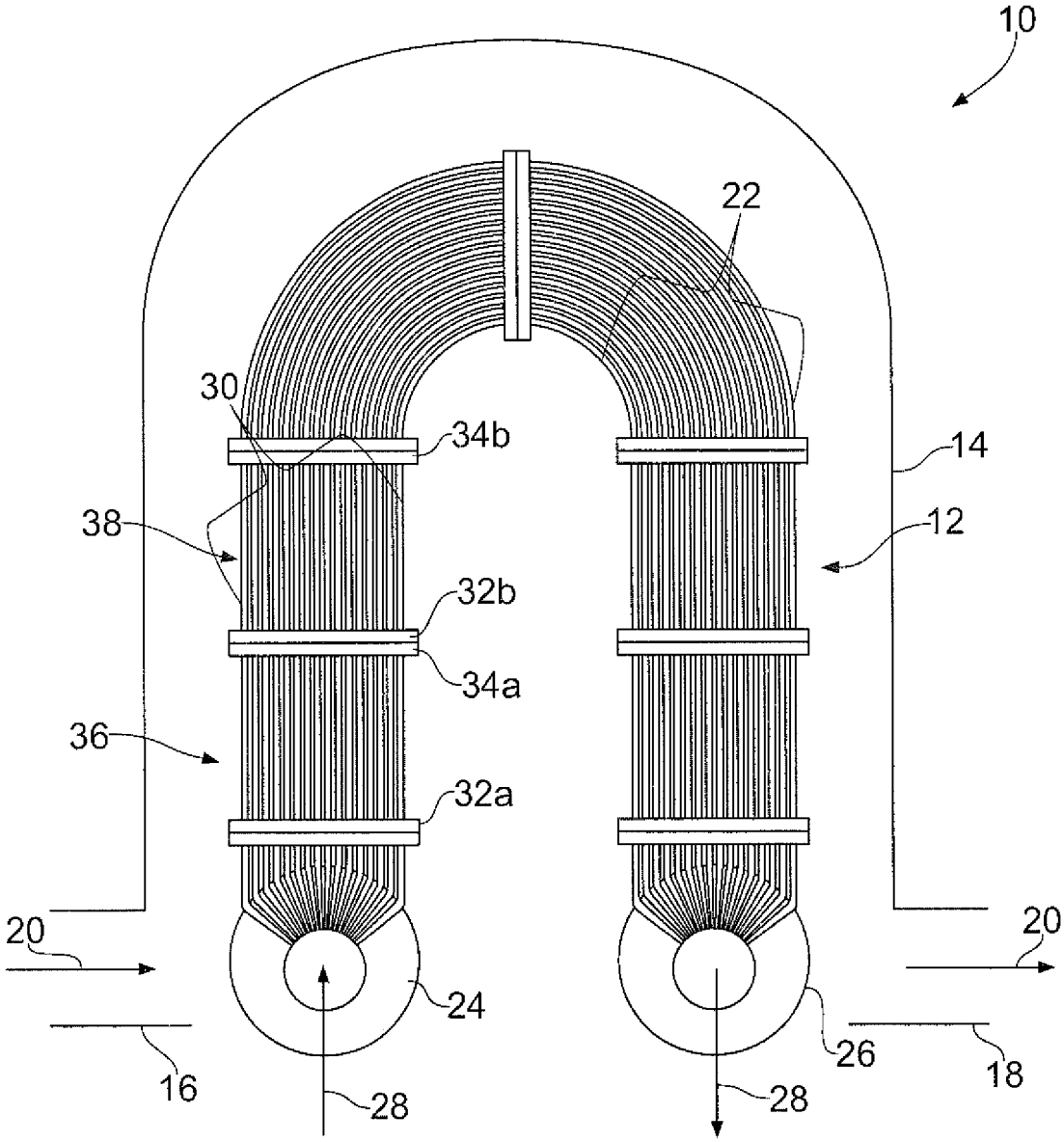
FIG. 1 illustrates a cross section of a steam generator.

Referring to FIG. 1 a steam generator is indicated generally at 10. The steam generator includes a conduit bundle 12 partially contained within a vessel 14. The vessel 14 includes an inlet 16 and an outlet 18. In the present embodiment, the vessel is formed using conventional methods and design, so will not be described in more detail here. In use, a primary fluid flow (indicated by arrow 20) enters the steam generator through the inlet 16, flows through the vessel 14 and exits the steam generator though outlet 18.

The conduit bundle 12 includes a plurality of conduits 22. The conduits are arranged so that an inlet of each conduit connects to an inlet header 24 and an outlet of each conduit connects to an outlet header 26. In use, a secondary fluid flow (indicated by arrow 28) flows through the conduit bundle, entering each conduit of the bundle at the inlet header 24 and exiting each conduit of the bundle at the outlet header 26.

As will be understood by those skilled in the art, the pressure of the primary fluid flow 20 will be greater than the pressure of the secondary fluid flow 28. As will be discussed later, during use of the steam generator 10 it is important that the secondary fluid flows through the conduits 22 and the primary fluid is external to the conduits.

In the present embodiment, each of the conduits 22 are an inverted U-shape and so form an inverted U-shaped conduit bundle 12.

The conduit bundle 12 is formed as a modular arrangement, In the present embodiment, to form the U-shaped conduit bundle, two end modules for connecting to the inlet header 24 and the outlet header 26, four straight tubed modules and two arcuate modules are provided. However, the conduit bundle may comprise any number of modules (e.g. two or more modules) depending on the requirements (e.g. size and heat transfer requirements) of a given steam generator, and the modules may take any suitable form.

Each module comprises a plurality of tubes 30 (only one set of tubes labelled for improved clarity), and a plate 32*a*, 32*b*, 34*a* and 34*b* (only four plates labelled for clarity) associated with at least one axial end of the tube (a plate is associated with both axial ends of the tubes for all modules except the two end modules that connect to the headers 24, 26).

Considering the modules indicated at 36 and 38 in FIG. 1. Module 36 is connected in series to module 38 and modules 36 and 38 are positioned so that the tubes of module 36 are coaxial with the tubes of module 38. A plate 32*a* is positioned at one end of the tubes of one module 36 and another plate 34*a* is positioned at an opposite axial end of the tubes of the module 36. Similarly, a plate 32*b* is positioned at one axial end of the tubes of the module 38 and another plate 34*b* is positioned at an opposite end of the tubes of the module 38.

Figure 2:
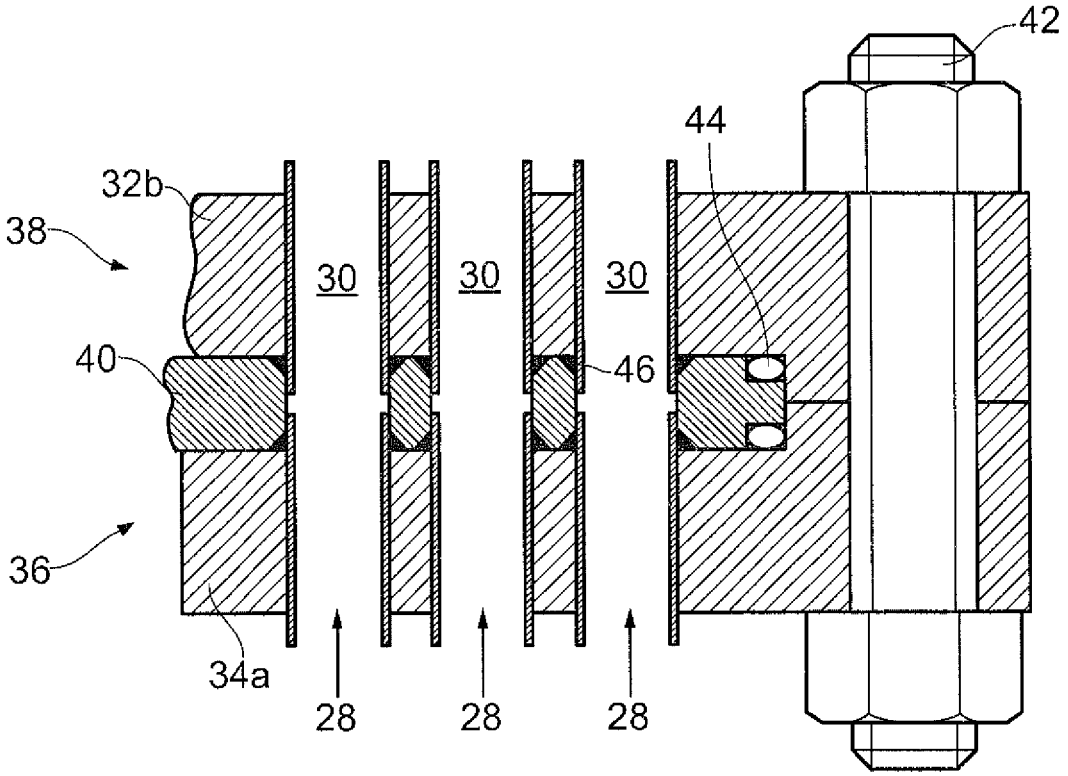
FIG. 2 illustrates a cross section through a connector between two conduit modules of the steam generator of FIG. 1.

Referring now to FIG. 2, the plates include a series of holes dimensioned to receive each of the tubes 30 of the respective module. That is, as illustrated in FIG. 2, the plate 34*a* receives each of the tubes of the module 36 and the plate 32*b* receives each of the tubes of the module 38. In this way, the plates 34*a*, 32*b* support the tubes and define the spacing therebetween.

An intermediate plate 40 is provided between the plates 34*a* and 32*b* of the modules 36, 38. The intermediate plate 40 includes a plurality of holes and receives tubes from both the module 36 and the module 38. The axial ends of each hole in the intermediate plate are chamfered (in the region 46 indicated for one hole) to reduce the likelihood of mechanical interference between the tubes of each module and the intermediate plate. In the present embodiment, the tubes are a close fit to the holes in the intermediate plate.

In the present embodiment, the flange plates 34*a*, 32*b* include a recess within which the intermediate plate is seated. An O-ring seal 44 is provided around the edge of the intermediate plate to improve sealing between the intermediate plate and the two flange plates 34*a*, 34*b*.

The two flange plates 34*a*, 34*b* and the intermediate plate 40 are connected together using a fastener 42. In the present embodiment the fastener is a bolt and nut, but any suitable fastener may be used.

The flange plates 34*a*, 34*b* have two main functions: as a tube sheet and as a mechanical interface with another conduit module 12. As a tube sheet, the flange plates provide a mechanical location for the tubes. As a mechanical interface, the flange plates provide a means of aligning and attaching an adjacent module.

The thickness of the flange may be minimised so as to reduce weight. However, the thickness of the flange will also be selected so as to allow for tube expansion and to maintain structural integrity (e.g. to avoid unacceptable bending or distortion of the flanges). The flanges may be clad to improve structural integrity.

An exemplary use of the steam generator 10 is in a pressurised water reactor (PWR). In such an exemplary embodiment, the inlet 16 of the vessel 14 receives a primary fluid flow (e.g. liquid water) from a reactor. By way of illustration only, the absolute pressure of the fluid entering the inlet 16 may be about 15 MPa, but the skilled person will understand that this can vary depending on reactor design and reactor loading. The primary fluid flow circulates through the vessel and exits through the outlet 18 where it re-circulates to the reactor.

The inlet of the conduit bundle 12 receives a secondary fluid flow (e.g. liquid water) from a condenser. By way of illustration only, the absolute pressure of the fluid entering the inlet of the conduit bundle may be about 6 MPa, but the skilled person will understand that this can vary depending on reactor design and reactor loading. The secondary fluid flows along each conduit of the conduit bundle flowing from one tube of one module to a coaxial tube of an adjacent module. The secondary fluid flow then exits the conduit bundle at the outlet header 26, for example as saturated steam. The secondary fluid then flows to a turbine and back to the condenser. The turbine is generally connected to a generator to generate electricity.

During operation of the steam generator, the pressure differential between the lower pressure fluid inside the conduit bundle and the higher pressure fluid outside the conduit bundle ensures that the flange plates remain connected and there is no leakage between the primary fluid flow and the secondary fluid flow.

The modular arrangement of the conduit bundle means that large steam generators can be manufactured as smaller individual modules, which eases transportation and installation of steam generators because the component parts are smaller. Further, maintenance of the described steam generator may be eased because a single module can be inspected and/or replaced as required. The modularity of the conduit may also provide the following benefits:

Size limitations within a supply chain can be removed;

Larger steam generators can be manufactured;

An increased choice of materials and material suppliers for the tubes; and

Production, validation and manufacture of steam generators can be eased.

Generally, tube supports are provided to support the conduits of the conduit bundle in the vessel. The construction of the described embodiment means that in some steam generator designs it will be possible to eliminate tube supports, for example if the tube length is selected to be below that where significant vibration would occur. Alternatively, it may be possible for the tube supports to become part of the module structure.

It will be appreciated by one skilled in the art that, where technical features have been described in association with one or more embodiments, this does not preclude the combination or replacement with features from other embodiments where this is appropriate. Furthermore, equivalent modifications and variations will be apparent to those skilled in the art from this disclosure. Accordingly, the exemplary embodiments of the invention set forth above are considered to be illustrative and not limiting.

Figure 3A:
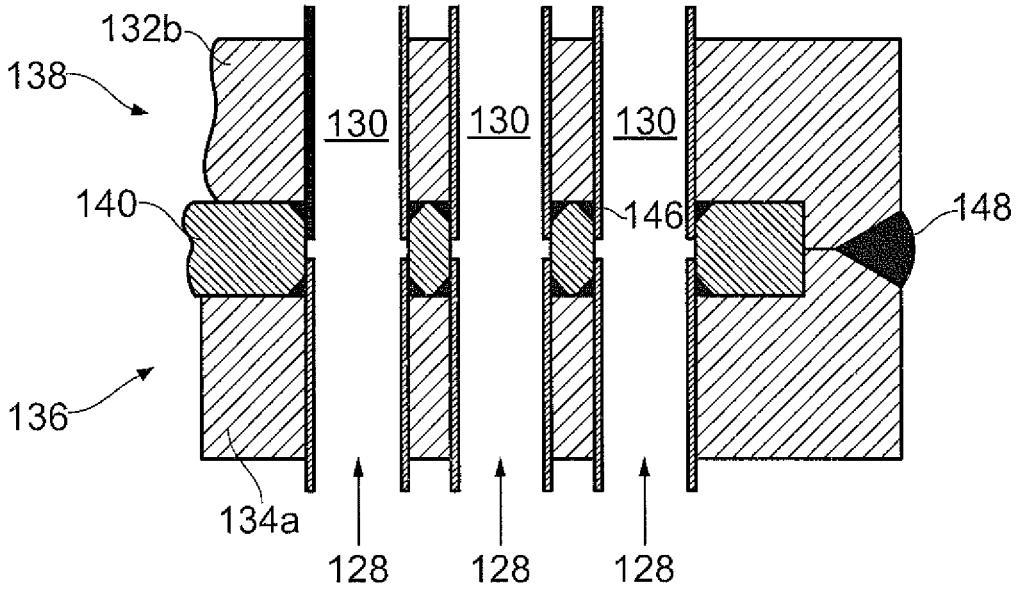
FIG. 3A and 3B each illustrate a cross section through alternative connections between two conduit modules.
Figure 3B:
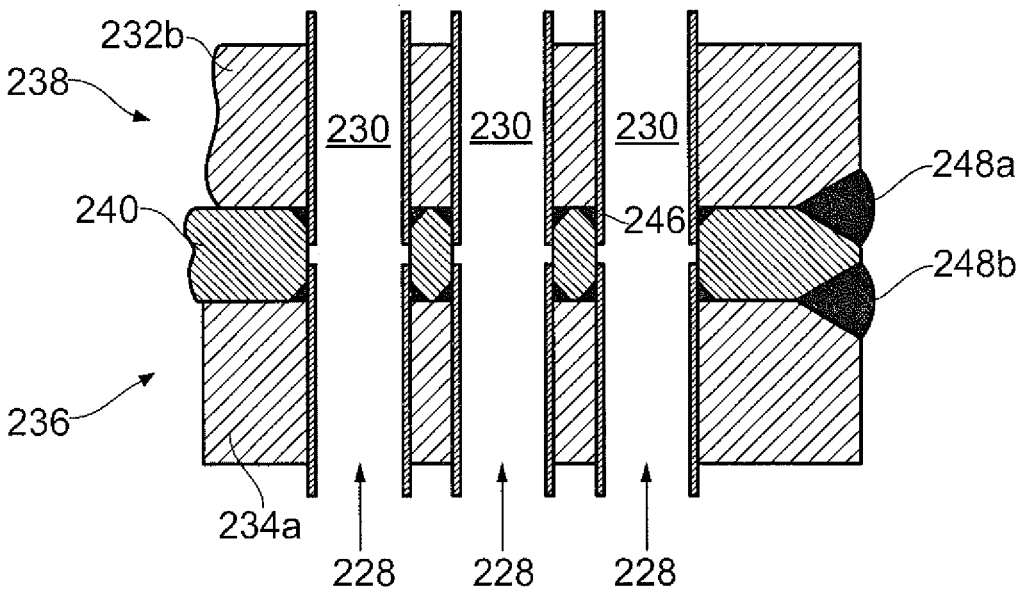

For example, the flange plates of each conduit bundle may be connected using an alternative arrangement, for example the arrangements shown in FIGS. 3A and 3B. In FIGS. 3A and 3B similar reference numerals are used for similar features as the previously described embodiment, but a prefix "1" or "2" is used to distinguish between embodiments.

In the arrangement shown in FIG. 3A, an intermediate plate 140 is positioned in a recess and between the flange plates 134*a*, 132*b*, similar to the previously described embodiment, such that an edge region of the two flange plates abuts against each other. However, instead of using an O-ring and a fastener, the flange plates are welded together in a region 148 along an abutment interface between the two flange plates.

In the arrangement shown in FIG. 3B, an intermediate plate 240 is provided similarly to the arrangement shown in FIG. 3A, but in the arrangement shown in FIG. 3B the intermediate plate extends the full width of the flange plates, i.e. no recesses are provided in the flange plates for receiving the intermediate plate. The intermediate plate is then welded to each of the flange plates in a region 248*a* and 248*b* along an abutment interface between the intermediate plate and the flange plates.

Figure 4:
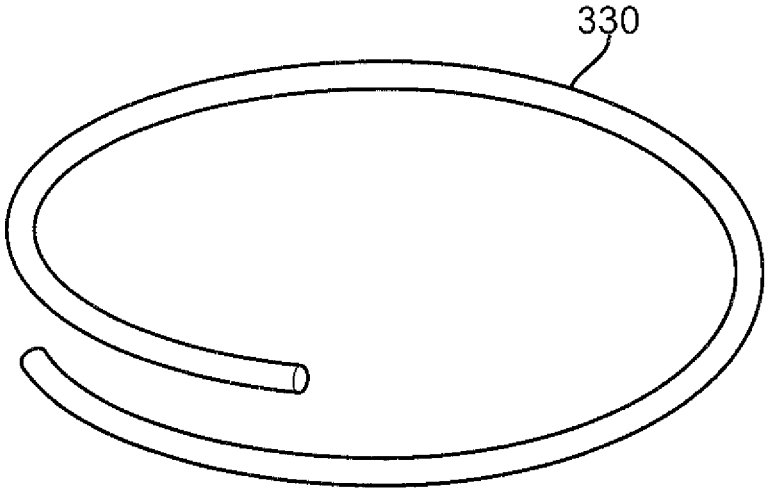
FIG. 4 illustrates a tube of a conduit module of an alternative steam generator.

The example shown in FIG. 1 includes inverted U-shaped conduit bundles, but in alternative embodiments the conduit bundles may take any suitable form. For example, the conduit bundles may be helical (or coiled). In such embodiments, each module may define one or more of the loops of the helical conduit, FIG. 4 illustrates a tube 330 from a module of a helical conduit.

In another alternative embodiment, the flange plates may not be a distinct component from the vessel and may instead be integrated with the vessel (e.g. with the wall/shell of the vessel).

In a further alternative, the steam generator may include a single conduit and corresponding single conduit modules, as an alternative to conduit bundles.

The invention claimed is:

1. A steam generator comprising:

a vessel having an inlet and an outlet, wherein in use, a primary fluid flow enters the vessel through the inlet and exits the vessel through the outlet; and a plurality of modules connected in series and at least partially housed within the vessel, wherein each module comprises:

a plurality of tubes, and a flange plate positioned at an axial end of the plurality of tubes, wherein the modules are arranged such that each of the plurality of tubes of one module is coaxial with one of the plurality of tubes of an adjacent module so as to form a conduit bundle comprising a plurality of conduits through which a secondary fluid can flow from one module to an adjacent module, and wherein adjacent modules of the plurality of modules are connected together via the flange plates of the adjacent modules, and wherein an intermediate plate is positioned between adjacent flange plates of the adjacent modules, the intermediate plate comprising a plurality of holes, each hole receiving one of the plurality of tubes of each of the adjacent modules, and the axial end of the plurality of tubes of the one module and the axial end of the plurality of tubes of the adjacent module are both located within the intermediate plate.

2. The steam generator according to claim 1, wherein each flange plate comprises a plurality of holes, each hole receiving one of the plurality of tubes.

3. The steam generator according to claim 1, wherein the intermediate plate and two flange plates are bolted together.

4. The steam generator according to claim 1, wherein the intermediate plate and the flange plates are welded together.

5. The steam generator according to claim 1, further comprising a seal between adjacent flange plates and the intermediate plate.

6. The steam generator according to claim 1, wherein the flange plates are formed as a separate component to the tubes.

7. The steam generator according to claim 6, wherein one or more of the plurality of flange plates are integrally formed with the vessel.

8. The steam generator according to claim 1, wherein the conduit is U-shaped.

9. The steam generator according to claim 1, wherein the conduit is helical.

10. The steam generator according to claim 9, wherein one tube defines one turn of the helical conduit and an adjacent tube defines an adjacent turn of the helical conduit.

11. A steam generator system comprising the steam generator according to claim 1; a primary fluid flow channel connecting to the inlet of the vessel and for connection to a heat source; and a secondary fluid flow channel connecting to the outlet of the vessel and for connection to a turbine.

12. A steam generator comprising one or more tube bundles, the steam generator being configured to receive a secondary flow through the tube bundles and a primary flow outside the tube bundles;

wherein each tube bundle comprises a first sub-bundle connected in series to a second sub-bundle, wherein each of the first and second sub-bundles comprise a plate including a plurality of holes, each hole receiving one of a plurality of tubes of the respective first or second sub-bundle, and wherein the plate of the first sub-bundle connects to the plate of the second sub-bundle with an intermediate plate positioned between the plates of the first and second sub-bundles, the intermediate plate comprising a plurality of holes, each hole receiving one of the tubes of each of the first and the second sub-bundles, an axial end of the plurality of tubes of the first sub-bundle and an axial end of the plurality of tubes of the second sub-bundle are both located within the intermediate plate, and the first and second sub-bundles and the intermediate plate are arranged such that the tubes of the first sub-bundle are substantially coaxial to the tubes of the second sub-bundle, such that in use, fluid flows from the first sub-bundle to the second sub-bundle.

13. The steam generator according to claim 1, wherein each of the plurality of holes of the intermediate plate include a chamfered axial end.

14. The steam generator according to claim 1, wherein the vessel is configured to receive the primary fluid as a pressurized liquid.

15. The steam generator system according to claim 11, wherein the heat source is a nuclear reactor.

16. A nuclear power plant steam generator comprising:

a vessel having an inlet and an outlet, wherein in use, a primary fluid flow from a nuclear reactor of the nuclear power plant enters the vessel through the inlet and exits the vessel through the outlet; and a plurality of modules connected in series and at least partially housed within the vessel, wherein each module comprises:

a plurality of tubes, and a flange plate positioned at an axial end of the plurality of tubes, wherein the modules are arranged such that each of the plurality of tubes of one module is coaxial with one of the plurality of tubes of an adjacent module so as to form a conduit bundle comprising a plurality of conduits through which a secondary fluid can flow from one module to an adjacent module, and wherein adjacent modules of the plurality of modules are connected together via the flange plates of the adjacent modules, and wherein an intermediate plate is positioned between adjacent flange plates of the adjacent modules, the intermediate plate comprising a plurality of holes, each hole of the plurality of holes of the intermediate plate receiving one of the plurality of tubes of each of the adjacent modules, and the axial end of the plurality of tubes of the one module and the axial end of the plurality of tubes of the adjacent module are both located within the intermediate plate.

* * * * *